US011505441B2

(12) United States Patent
Gebendorfer

(10) Patent No.: US 11,505,441 B2
(45) Date of Patent: Nov. 22, 2022

(54) METHOD AND DEVICE FOR DISPLACING AIR FROM BOTTLES OF CARBONATED BEVERAGES

(71) Applicant: Krones AG, Neutraubling (DE)

(72) Inventor: Simon Gebendorfer, Herrngiersdorf (DE)

(73) Assignee: Krones AG, Neutraubling (DE)

( * ) Notice: Subject to any disclaimer, the term of this patent is extended or adjusted under 35 U.S.C. 154(b) by 166 days.

(21) Appl. No.: 16/560,694

(22) Filed: Sep. 4, 2019

(65) Prior Publication Data

US 2020/0071149 A1 Mar. 5, 2020

(30) Foreign Application Priority Data

Sep. 4, 2018 (DE) ..... 102018214972.0

(51) Int. Cl.
*B67C 3/22* (2006.01)

(52) U.S. Cl.
CPC ..... *B67C 3/222* (2013.01)

(58) Field of Classification Search
CPC ... B67C 3/222; B67C 3/22; B67C 2003/2671; B65B 3/22; B65B 31/04; B01D 19/0036; B01D 19/02
See application file for complete search history.

(56) References Cited

U.S. PATENT DOCUMENTS 3,103,424 A 9/1963 Hosking
4,531,405 A * 7/1985 Leister ..... G01F 23/14 73/290 R
5,973,441 A * 10/1999 Lo ..... H01L 41/098 310/353
6,106,590 A * 8/2000 Ueno ..... B01D 19/0078 95/266
8,037,907 B2 10/2011 Haas et al.
2007/0012334 A1* 1/2007 Wolters ..... B08B 9/28 134/1
2008/0049078 A1* 2/2008 Zhang ..... B41J 2/1753 73/290 R
2008/0211838 A1* 9/2008 Zhang ..... B41J 2/1753 347/7
2009/0308487 A1* 12/2009 Collings ..... B06B 3/00 181/188

(Continued)

FOREIGN PATENT DOCUMENTS

DE 1104845 B 4/1961
DE 1117431 B 11/1961

(Continued)

*Primary Examiner* — Anna K Kinsaul
*Assistant Examiner* — Luis G Del Valle
(74) *Attorney, Agent, or Firm* — McCoy Russell LLP

(57) ABSTRACT

A method and a device are described for displacing air from bottles of carbonated beverages. Sound waves may be emitted from at least one sound source and propagate through the ambient air, penetrate through the mouths into the beverage and/or make the walls of the bottles vibrate so that $CO_2$ is expelled from the beverage and the beverage foams in the headspace such that air contained therein is displaced through the mouth. The oxygen content in the beverage can thus be reduced flexibly and in an adjustable manner with comparatively little expenditure on equipment and for different bottle formats.

12 Claims, 3 Drawing Sheets

(56) References Cited

U.S. PATENT DOCUMENTS

| | | | | |
|---|---|---|---|---|
| 2011/0272060 | A1* | 11/2011 | Clusserath | B65B 3/22 141/69 |
| 2012/0037183 | A1* | 2/2012 | Foley | B08B 1/00 15/97.1 |
| 2012/0208901 | A1* | 8/2012 | Takenouchi | B01D 19/02 422/127 |
| 2015/0191262 | A1* | 7/2015 | Suenaga | B01L 3/505 53/111 R |
| 2020/0071149 | A1* | 3/2020 | Gebendorfer | B67C 3/222 |

FOREIGN PATENT DOCUMENTS

| | | | | | |
|---|---|---|---|---|---|
| DE | 2435011 | A1 | | 2/1976 | |
| DE | 8507507 | U1 | | 5/1985 | |
| DE | 8511725 | U1 | | 2/1991 | |
| DE | 4135438 | A1 | | 4/1993 | |
| DE | 102006022464 | A1 | | 11/2007 | |
| DE | 102012007314 | A1 | | 10/2013 | |
| EP | 2746216 | A1 | * | 6/2014 | B67C 3/26 |
| GB | 797679 | A | | 7/1958 | |
| JP | 07291395 | A | * | 11/1995 | B67C 3/22 |
| WO | 2010112141 | A2 | | 10/2010 | |

* cited by examiner

METHOD AND DEVICE FOR DISPLACING AIR FROM BOTTLES OF CARBONATED BEVERAGES

CROSS REFERENCE TO RELATED APPLICATIONS

The present application claims priority to German Application No. 10 2018 214 972.0 entitled "METHOD AND DEVICE FOR DISPLACING AIR FROM BOTTLES OF CARBONATED BEVERAGES", filed on Sep. 4, 2018. The entire contents of the above listed application are hereby incorporated by reference for all purposes.

TECHNICAL FIELD

The present disclosure relates to a method and a device for displacing air from bottles of carbonated beverages.

BACKGROUND AND SUMMARY

When bottling carbonated beverages, it is necessary, especially with a high vitamin C content or, for example, also with beer, to remove air that is present in the headspace of the bottles after the filling process in order to prevent product reactions with oxygen.

For this purpose, for example, a fine jet of hot water can be injected at a high pressure into the bottle during the transfer between the filler and the capper. This releases dissolved $CO_2$ from the product. As a result, $CO_2$ bubbles rise in the product and create foam that displaces the air above it from the bottleneck.

Such foaming by injecting liquid is known, for example, from DE 10 2006 022 464 A1, foaming by injecting gas into a carbonated beverage from GB 797 679 A.

DE 10 2012 007 314 A1 also described the immersion of an ultrasonic vibrator in a carbonated beverage, DE 1 121 955 A described oscillating members for the lateral placement onto bottle shoulders and transmitting ultrasound, and DE 85 07 507 U1 described vibration transmission through a sliding plate on bottle bases.

A disadvantage of injection methods is the comparatively high energy consumption, the need for suitably pretreated injection media, such as degassed water, the undesired introduction of oxygen by turbulence in the headspace of the bottles, and the comparatively complex control of the pumps required for the injection Generating vibrations in contact with the bottle walls and/or bottle bases requires that the respective sound generators and transfer media be carried along with the bottles during transport and/or results in the formation of foam that is difficult to control.

There is therefore a need in this respect for improved methods and devices for displacing air from bottles of carbonated beverage.

This object posed is satisfied with a method. Air can be displaced with this method from bottles of carbonated beverages in that sound waves are emitted from at least one sound source, propagate through the ambient air, penetrate through the mouths into the beverage and/or make the walls of the bottles vibrate so that $CO_2$ is expelled from the beverage and it foams in the headspace such that air contained in the headspace is displaced through the mouth.

The sound waves may be ultrasonic waves. The sound waves propagate, for example, via the air that is present in the headspace to the beverage and penetrate thereinto. The sound waves coupled in in such a manner are reflected at the base of the bottle and return to the headspace of the bottle. In the process, sound waves coupled in and returning overlap and standing sound waves can form in the beverage.

Standing sound waves can be formed by the reflection of sound waves from the base of the bottles and/or from the sidewalls of the bottles.

The expulsion of $CO_2$ from the beverage is based on the generation of standing sound waves in the beverage, where pressure fluctuations develop at wave nodes which release $CO_2$ dissolved in the beverage by way of cavitation (falling below the saturation pressure and turbulences). This now undissolved $CO_2$ rises to the surface of the beverage and there creates the foam required for the displacement of air.

First sound waves may be directed toward the walls of the bottles, and the output frequency of the sound waves is adjusted to a natural resonance frequency of the filled bottles. This enables the formation of standing waves in the beverage at comparatively low energy input, since the sound waves coupled in by ambient air are amplified by the natural resonance of the bottles.

The output frequency of the first sound waves may be tuned. As a result, the bottles can be reliably excited with the respective individual natural resonance frequency despite the production-related scattering of the natural resonance frequency. For this purpose, the output frequency is, for example, raised or lowered continuously over a suitable tuning range. The tuning range then comprises, for example, the range of production-related possible individual natural resonance frequencies of a specific bottle format or bottle batch. All bottles to be filled can then at least temporarily be excited to perform wall vibrations at the respective natural resonance.

The output frequency may be tuned on the basis of a standard natural resonance frequency associated with the respective bottle format and/or the beverage and/or its filling level. The standard natural resonance frequency is, for example, an average value of the natural resonance frequency for a particular bottle format. For example, suitable tuning ranges above and below the standard natural resonance frequency are in particular continuously tuned. The scope of the tuning range can be adapted to the scattering of the natural resonance expected for a particular bottle format. This enables a reliable and overall rapid excitation of the wall vibration and therefore efficient foaming.

The first sound waves may be received at different output frequencies and the natural resonance frequency of a particular bottle or number of bottles of a particular bottle format is determined by comparing signal amplitudes of sound waves received. It is thus possible to determine both the natural resonance frequencies of individual bottles as well as a statistical scattering of the natural resonance frequency, for example, as their average value and/or standard deviation for a specific bottle format.

Second sound waves may be directed through the mouths of the bottles onto the bases of the bottles, thereby generating standing waves in the beverage. This allows it to be comparatively easy to control coupling the sound waves into the beverage.

The second sound waves may then directed to at least one curved wall portion of the bases. With system-related fluctuations in the filling level of the beverage in the bottles, standing waves can then form at different partial sections of the curved wall portions depending on the filling level.

In principle, generating standing waves is dependent on the distance of the sound generator from the respective base of the bottle and the filling level of the beverage in the respective bottle. This arises from the fact that the sound frequency in air and in the beverage is identical, but the wavelength changes depending on the propagation speed of the sound waves in the air and in the beverage. A partial section of the bottle base, which is arranged in relation to the filling level at a distance that is suitable for the formation of standing waves, is sufficient for the generation of standing waves in the beverage. Standing waves can therefore be generated relatively reliably without changing the distance between the sound source and the base of the bottle.

The amplitudes of the first and/or the second sound waves may be set depending on the format. The formation of foam can be optimized for different bottle sizes and bottle shapes in terms of their magnitude and the energy input necessary for this.

The first and/or the second sound waves may be generated by at least one piezoceramic speaker. This allows for comparatively flexible tuning of the sound frequency and a sound generation that is flexibly adaptable to the spatial conditions.

Alternatively, the first and/or the second sound waves are generated in an advantageous manner by at least one piezoceramic spherical cap and focused to form shock waves. This enables a particularly efficient release of $CO_2$ from beverages with respective foaming in the headspace of the bottles.

The object posed is also satisfied with a device. According thereto, the device is configured to displace air from bottles of carbonated beverages following the method according to at least one of the embodiments described above and comprises a transport device for the bottles and at least one sound source, arranged stationarily in the region of the transport device and at a distance from the bottles, for emitting sound waves, firstly, through the mouths and/or, secondly, from the outside onto sidewalls and/or bases of the bottles. The advantages described can be obtained therewith.

A sound source with an automatically tunable output frequency is present for the external irradiation of the sidewalls and/or bases of the bottles, in particular in the form of a piezoceramic speaker. As a result, the bottles can be reliably excited to vibrate at their natural resonance frequency, in particular, also when their natural resonance frequency is scattered due to production-related circumstances. This enables a particularly efficient release of $CO_2$ from beverages with the respective formation of foam for displacing air from the headspace of the bottles.

A sound source with an automatically adjustable distance to the bases of the bottles and/or with automatically adjustable output frequency is advantageously present for the mouths of the bottles, in particular, in the form of a piezoceramic spherical cap for generating shock waves. As a result, standing waves due to sound reflection from the bases of the bottles can be reliably generated by adjusting the distance of the sound source from the bottle bases and/or from the filling level of the beverage.

BRIEF DESCRIPTION OF THE DRAWINGS

Example embodiments of the present disclosure are shown in the drawings, where.

DETAILED DESCRIPTION OF THE DRAWINGS

Figure 1:
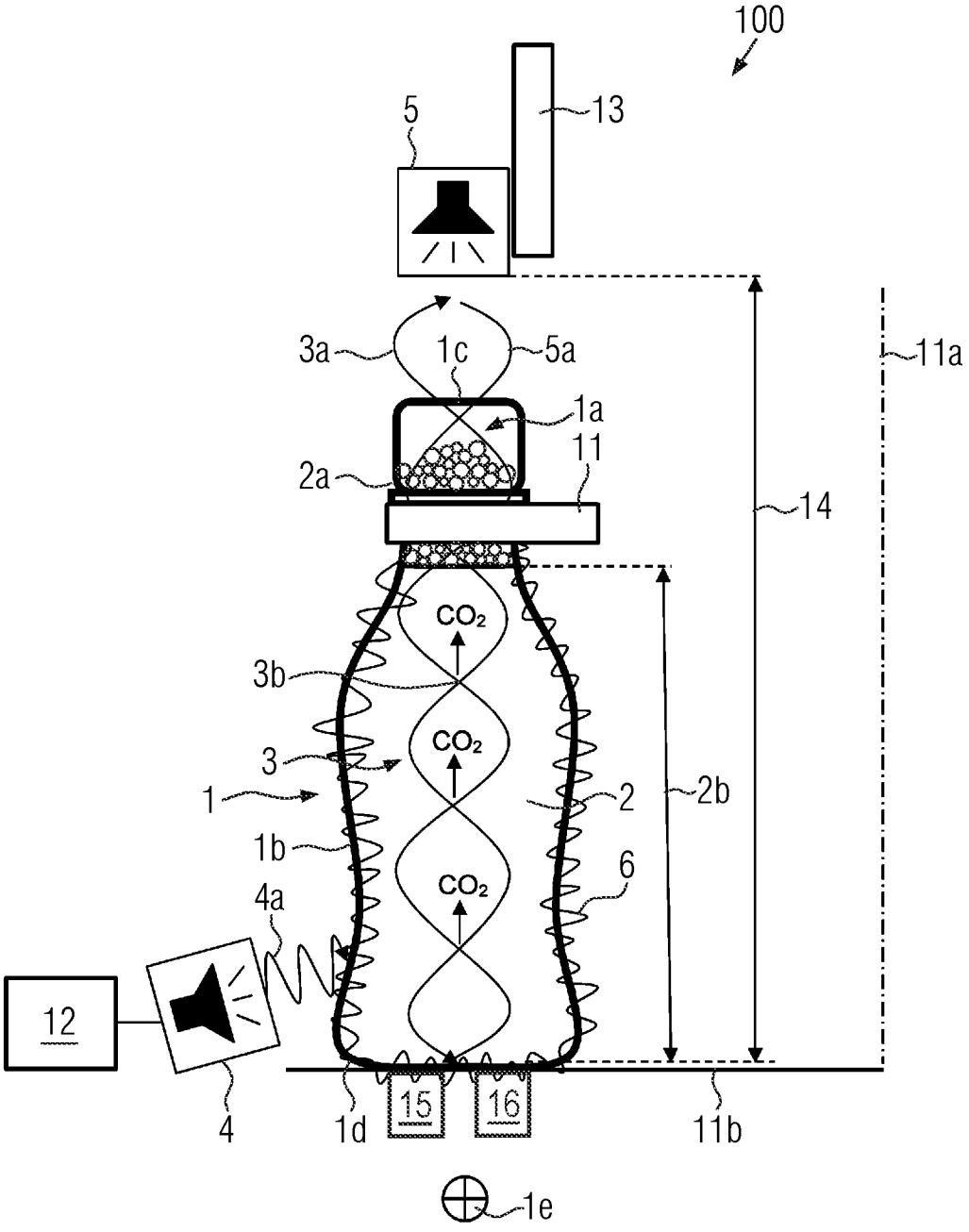
FIG. 1 is a schematic representation of a bottle when $CO_2$ is expelled.

As indicated schematically by FIG. 1, device 100 according to the present disclosure and the method performed therewith serve to expel $CO_2$ from bottles 1 of carbonated beverages 2, such as beer, lemonade containing vitamin C or the like, by way of standing sound waves 3 which are generated, for example, by a first sound source 4 and/or a second sound source 5. This results in foam 2*a* arising which ultimately displaces the air existing in headspace 1*a* of bottles 1 and the oxygen contained therein.

First sound source 4 is directed from the outside onto a sidewall 1*b* of a bottle 1. Second sound source 5 is directed through mouth 1*c* of bottle 1, and therefore from the inside, onto its base 1*d*, so that standing sound waves 3 form in beverage 2 due to sound reflection from base 1*d*. A base 1*d* with curved wall sections, as indicated schematically, is advantageous for the reliable formation of standing sound waves 3, in particular, with individually different bottle dimensions and/or filling levels 2*b*.

First sound source 4 operates by way of first sound waves 4*a* that are contactlessly transmitted through the ambient air to sidewall 1*b*. Second sound waves 5*a* emitted from second sound source 5 are also contactlessly coupled into beverage 2 through the ambient air and mouth 1*c*.

Only a single standing sound wave 3 is illustrated for the sake of clarity, which is formed by a second sound wave 5*a* emitted by second sound source 5, a sound wave 3*a* returning after reflection from base 1*d*, and common wave nodes 3*b*. Expelling $CO_2$ dissolved in beverage 2 is based to its release due to pressure fluctuations in beverage 2, in particular, at wave nodes 3*b*.

Figure 2:
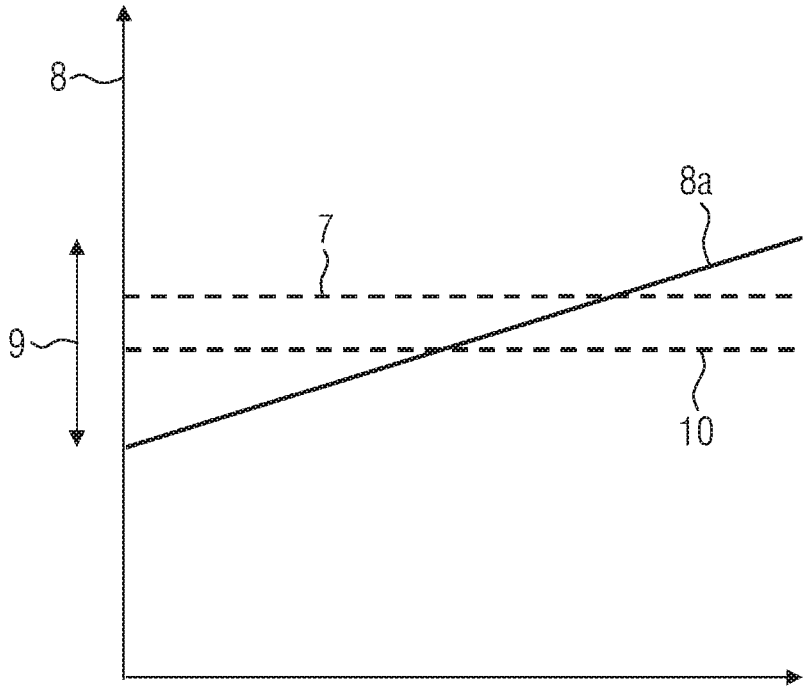
FIG. 2 is a schematic representation of tuning the output frequency emitted.

Schematically indicated is further a wall vibration 6 in sidewall 1*b* and in base 1*d* of bottle 1 which is excited by first sound source 4 enhancing the formation of foam and which has a natural resonance frequency 7 (shown in FIG. 2). The latter can fluctuate individually for a particular bottle format due to production-related circumstances and/or for a particular beverage 2, for example, also depending on filling level 2*b*.

Accordingly, FIG. 2 in a schematic frequency-time diagram illustrates that output frequency 8 of first sound source 4 can be tuned during a suitable treatment period of individual bottles 1. For this purpose, output frequency 8 may be continuously raised and/or lowered over a tuning range 9 covering the possible natural resonance frequencies 7 of all bottles 1 to be treated.

Tuning range 9 can be based on a standard natural resonance frequency 10 depending on the format and/or depending on the beverage and/or depending on the filling level and be respectively determined for bottles 1 to be treated such that, during the tuning, output frequency 8 temporarily coincides with the actual natural resonance frequency 7 of each filled bottle. A wall vibration 6 enhancing the foaming can thus at least temporarily be excited reliably on all bottles 1, even with systematically caused scattering of individual natural resonance frequency 7.

Tuning output frequency 8 in the example shown leads to a linearly increasing frequency-time sequence 8*a*. Linearly lowering output frequency 8 or other frequency-time sequences covering natural resonance frequency 7 are likewise conceivable.

Tuning range 9 may be determined specifically for the format and/or specifically for the product, i.e. possibly also depending on beverage 2 filled into bottle 1. For this purpose, for example, the statistical variation of bottle dimensions and/or filling level 2*b* can be incorporated into determining tuning range 9.

To determine natural resonance frequency 7 of individual bottles 1 and/or a statistical scattering of natural resonance frequency 7 for a particular bottle format with the associated beverage, for example, as an average value and standard deviation, bottles 1 can be irradiated by first sound source 4 at different output frequencies 8 and signal amplitudes registered by way of suitable sound receivers 15, 16 can be compared.

By statistical evaluation of such measurement results, it is then possible to calculate, for example, associated standard natural resonance frequencies 10 and/or associated tuning ranges 9 for individual combinations of possible bottle formats and beverages.

Device 100 for contactlessly coupling in sound waves 4*a*, 5*a* shown in FIG. 1 further comprises a (schematically indicated) transport device 11 with an associated axis of rotation 11*a* and an optional bearing surface 11*b* for bottles 1. Transport device 11 is, for example, a transfer starwheel or the like, from which a direction of transport 1*e* of bottles 1 with respect to the sound sources 4, 5 arises. In principle, however, it could also be a linear transport path in the form of a conveyor belt or the like.

In principle, it would be possible to additionally make bearing surface 11*b* vibrate in accordance with output frequency 8. In the example shown, however, wall vibration 6 at natural resonance frequency 7 is excited exclusively by first sound source 4.

First and/or second sound source 4, 5 can be formed, for example, as a piezoceramic speaker. In particular output frequency 8 of first sound source 4 can be automatically tuned by a controller 12.

A lifting device 13 can be provided for second sound source 5 to set a distance 14 between second sound source 5 and base 1*b* of bottles 1. Distance 14 and/or output frequency 8 can then be predetermined, for example, centrally by controller 12 by way of a touchscreen or similar input unit in a format-specific and/or beverage-specific manner.

In particular second sound source 5 could also be configured as a piezoceramic spherical cap for generating shock waves on the basis of convergent spherical waves. Due to the associated focusing, the sound can be coupled more effectively into beverage 2 and standing sound waves 3 can be generated particularly efficiently.

Piezoelectric elements can then be arranged in a single-layered or double-layered manner in the spherical cap in a manner known per se in order to be expanded at the same time by way of a high-voltage pulse in the micrometer range and to thus generate a pressure pulse in the adjacent medium. The piezoelectric elements are then known to be oriented toward a focus, in the region of which shock waves form.

Alternatively, electromagnetic pressure pulse or shock wave generation is conceivable with flat coils based on the working principle of a speaker. In this case, a flat membrane is deflected in an impact-loaded manner by electromagnetic forces creating a plane wave that is then suitably focused using an acoustic lens. Also in this case, the shock waves arise in the vicinity of the focus.

FIG. 1 shows first and second sound sources 4, 5 combined at any random transport position of bottle 1. In principle, foam 2*a* could also be created by releasing $CO_2$ from beverage 2 only using first sound source 4 or only using second sound source 5, in order to displace air that is present in headspace 1*a* of bottles 1 above beverage 2 with foam 2*a*.

It would also be conceivable to arrange several first sound sources 4 and/or several second sound sources 5 one behind the other on transport device 11 in direction of transport 1*e*. It would also be conceivable to arrange a first sound sources 4 and a second sound source 5 one behind the other on transport device 11 in direction of transport 1*e*.

Figure 3:
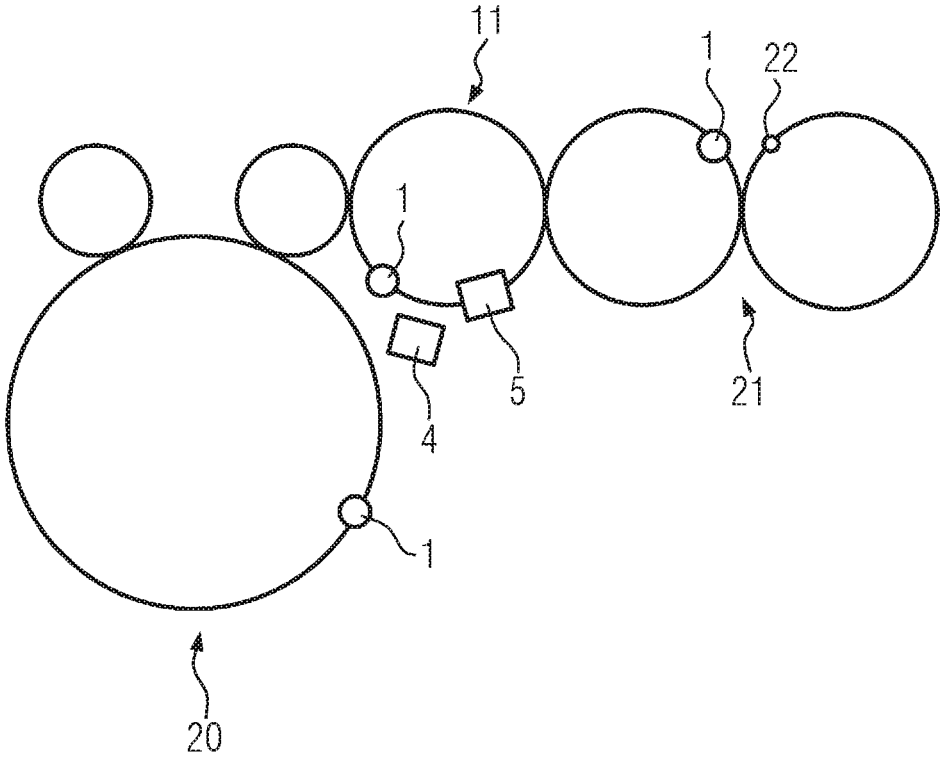
FIG. 3 is a schematic top view onto the device between a filler and a capper.

This is indicated by way of example in schematic FIG. 3. Visible there is a filler formed as a rotary machine with an inlet starwheel and an outlet starwheel and a capper 21 and transport device 11 formed therebetween as a transfer star with a first sound source 4 and a second sound source 5.

For example, a wall vibration 6 at natural resonance frequency 7 of bottles 1 could first be excited by way of first sound source 4, and the amount of foam 2*a* in bottles 1 could then be selectively controlled by coupling in sound waves 5*a* from second sound source 5. $CO_2$ is already released due to excited wall vibrations 6 and foam 2*a* is produced as a result. Its quantity can be adjusted, for example, by changing the sound amplitude of first sound source 4 and/or by selectively adjusting its output frequency 8. Regardless thereof, foaming can then be additionally controlled from above with second sound source 5.

However, in principle, any variants of simultaneously or successively acting first and/or second sound sources 4, 5 are conceivable.

Bottles 1 may be filled in filler 20 with beverage 2 in a continuous product flow and transferred from outlet starwheel of filler 20 to transport device 11. Sound waves 4*a*, 5*a* are coupled into sidewalls 1*b*, bases 1*c* and/or beverage 2 in the region of transport device 11 by way of first sound source 4 and/or second sound source 5 during the continuous transport of containers 1. As a result, $CO_2$ is expelled from beverage 2 and therewith forms foam 2*a* in headspaces 1*a* of bottles 1, so that previously existing air may be entirely displaced from headspaces 1*a*. The entry of oxygen into beverage 2 can thus be reduced to an acceptable level.

Thereafter, bottles 1 thus treated are fed to capper 21 and closed therein with closure caps 22 in a manner known per se. The further handling of sealed bottles 1 is known and therefore not further explained.

The vibration amplitude of sound waves 4*a*, 5*a* emitted by sound sources 4, 5 can be adapted centrally to the respective bottle format and/or beverage. Any series arrangement of sound sources 4, 5 along direction of transport 1*e* with individually adapted sound amplitudes is conceivable. This allows for particularly precise control of the formation of foam in bottles 1, in order to, firstly, expel as much as possible the air present above beverage 2 and at the same time to avoid foam 2*a* from overflowing.

Contactlessly coupling in sound waves 4*a*, 5*a* through the ambient air is flexible and adaptable to different bottle formats and beverages with comparatively little expenditure of equipment. In particular, no replacement of setup parts or the like is necessary for format adaptation.

Instead, possibly only output frequency 8, in particular for the excitation of wall vibration 6 at the natural resonance frequency 7 of filled bottle 1 and/or distance 14 between second sound source 5 and the inner walls of bases 1*d* are to be adapted specifically to the format, and/or specifically to the beverage or specifically to the filling level, respectively. An equally flexible and efficient displacement of the air from headspace 1*a* of bottles 1 is thereby given.

The formation of foam can be specifically controlled in particular by the following parameters:

- output frequency and/or sound amplitude of the sound source (s);
- distance of first sound source 4 from base 1*c* of the bottle;
- vibration form of the emitted sound waves, such as sinusoidal, sawtooth-shaped, rectangular or the like;

series arrangement of several separately controllable first and/or second sound sources 4, 5 between the filler and the capper; and/or the excitation to wall vibration 6 at natural resonance frequency 7 of filled bottles.

The following advantages can be obtain, for example:

Adjustment and control of the parameters described is possible centrally, for example on a touch screen, and in dependence of machine performance.

Foam 2*a* can be generated in a particularly selective manner, so that air is expelled out of headspace 1*a*, in particular, in a laminar manner and unwanted turbulence in headspace 1*a* is avoided.

Optimum hygiene due to contactless sound coupling;

No introduction of additional substances, such as water, into beverage 2, thereby maintaining product quality; and Low energy consumption.

The invention claimed is:

1. A method for displacing air from bottles containing carbonated beverages, comprising:

emitting sound waves from at least one sound source;

propagating the sound waves through ambient air;

penetrating through the mouths of said bottles into said beverages with the sound waves and/or making the sidewalls of said bottles vibrate with the sound waves, so that $CO_2$ is expelled from said beverages, thereby forming undissolved $CO_2$ that rises to the surface of the beverage and there creates foam displacing air present in headspaces of said bottles above said beverages through said mouths.

2. The method according to claim 1, where first sound waves are directed onto said sidewalls of said bottles and an output frequency is adapted to a natural resonance frequency of said bottles that are filled with said beverages.

3. The method according to claim 2, where said output frequency is tuned during emission of said first sound waves.

4. The method according to claim 3, where said output frequency is tuned on a basis of a standard natural resonance frequency associated with a respective bottle format of said bottles and/or said beverages and/or a filling level.

5. The method according to claim 1, where said bottles are irradiated with first sound waves at different output frequencies of a first sound source, where the first soundwaves are received by a sound receiver configured to register signal amplitudes, and where a natural resonance frequency is determined by comparing associated signal amplitudes of the received first soundwaves.

6. The method according to claim 1, where second sound waves are directed through said mouths of said bottles onto bases of said bottles and standing waves are thus generated in said beverages.

7. The method according to claim 6, where a distance of said at least one sound source from said bases of said bottles is adapted to at least one of a format of said bottles, a type of the beverage, and a filling level of the beverage.

8. The method according to claim 7, wherein the distance of said at least one sound source from said bases of said bottles is adapted automatically.

9. The method according to claim 6, where said second sound waves are directed onto a curved wall portion of said bases.

10. The method according to claim 1, where amplitudes of first and/or second sound waves of said sound waves are set individually.

11. The method according to claim 1, where first and/or second sound waves of the sound waves are generated by at least one piezoceramic speaker.

12. The method according to claim 1, where first and/or second sound waves of the sound waves are generated by at least one piezoceramic spherical cap and focused to form shock waves.

* * * * *